US005421263A

United States Patent [19]

Ruohonen

[11] Patent Number: 5,421,263

[45] Date of Patent: Jun. 6, 1995

[54] CARTRIDGE FOR SPRAYING A LIQUID INTO THE BARREL OF A FIREARM

[75] Inventor: Raimo Ruohonen, Pohjansaha, Finland

[73] Assignee: Raikka Oy, Eurajoki, Finland

[21] Appl. No.: 217,249

[22] Filed: Mar. 24, 1994

[51] Int. Cl.[6] ..... F42B 5/24

[52] U.S. Cl. ..... 102/435; 102/442

[58] Field of Search ..... 102/430, 435, 440, 442, 102/464, 465, 466, 467, 511, 512, 529; 42/95

[56] References Cited

U.S. PATENT DOCUMENTS

| | | | |
|---|---|---|---|
| 692,819 | 2/1902 | Bissel | 102/430 |
| 938,836 | 11/1909 | Fessenden | 102/442 |
| 2,765,740 | 10/1956 | Norman | 102/442 |
| 3,209,690 | 10/1965 | Mercatoris | 102/442 |
| 3,308,818 | 3/1967 | Rutkowski | 102/512 |
| 3,404,598 | 10/1968 | Angelos | 102/530 |
| 3,740,883 | 6/1973 | Kyle | 102/442 |
| 4,478,150 | 10/1984 | Sayler et al. | 102/430 |
| 4,843,750 | 7/1989 | Blase | 102/442 |
| 4,998,368 | 3/1991 | Blase | 102/442 |
| 5,072,672 | 12/1991 | Lefumeux | 102/435 |

FOREIGN PATENT DOCUMENTS

| | | | |
|---|---|---|---|
| 1003155 | 3/1952 | France | 102/435 |
| 3617814 | 12/1987 | Germany | 102/529 |

*Primary Examiner*—Harold J. Tudor

*Attorney, Agent, or Firm*—Scully, Scott, Murphy & Presser

[57] ABSTRACT

A cartridge for firearms, comprising a shell (1), a primer disposed in the shell, and a liquid space containing a liquid (5) to be spread on the inner surface of a barrel. According to the invention, the liquid space (3*a*) is formed by a cylinder within which there is mounted a piston (4). When the primer (2) is detonated by the action of a firing pin, the piston (4) propels the liquid (5) in front of it, whereby the liquid (5) expels a plug (6) from the orifice through which oil is to be sprayed and spreads as a spray on the inner surface of the barrel.

9 Claims, 2 Drawing Sheets

CARTRIDGE FOR SPRAYING A LIQUID INTO THE BARREL OF A FIREARM

Figure 1:
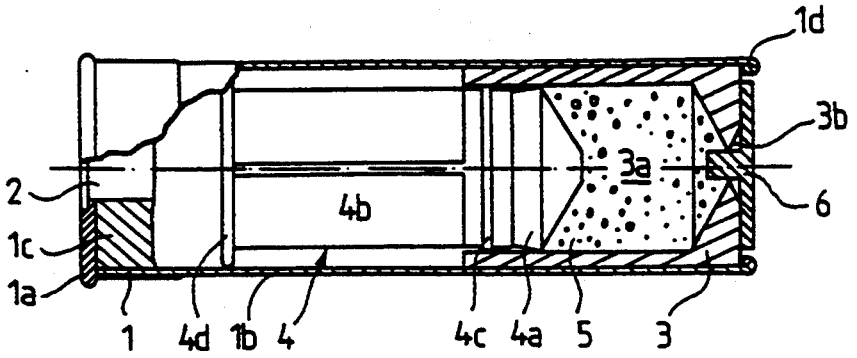

The invention relates to a cartridge for spraying a liquid into the barrel of a firearm, said cartridge comprising a shell, a propelling charge detonated by the action of a firing pin of the firearm, and a liquid space for the liquid to be sprayed.

When firearms are shot, the burning powder gas and detonating mass of the primer foul the inner surface of the barrel with e.g. corrosive compounds, wherefore the barrel must be cleaned and lubricated after use. This is effected normally by lubricating the barrel at first, and thereafter pushing clean tow or cloth through the barrel until all dirt has been removed. Finally a layer of oil is applied for protection on the inner surface of the barrel by tow or cloth immersed in oil. In practice, however, it is difficult to carry cleaning implements, such as a cleaning rod and oil, when hunting and in the field. Therefore cleaning is often performed later on. There are, however, situations where the barrel must be protected or cleaned on account of the conditions or the use of the firearm. For instance, if snow or debris enters the barrel or if drops of water freeze on the inner surface of the barrel, the barrel must be cleaned before shooting. Likewise there are situations where it would be useful if one could lubricate the barrel temporarily in order to prevent corrosion without having to carry a complete cleaning kit with oneself. Various cartridges have been developed to this end.

U.S. Pat. No. 2,765,740 discloses a solution in which the forward end of a cartridge is provided with a wad made of felt or other suitable material, and in which the rearward end is provided with a second cleaning wad connected to the first wad by means of springs. Powder is disposed in the space between the wads, and the cap of the cartridge is provided with a long primer, which detonates the powder when the firearm is discharged. The powder expels the first wad through the barrel and out of the firearm, whereafter the springs between the wads pull the second wad so that powder residue is removed from the barrel. The solution is rather complicated, and it cannot be assumed to function in a reliable manner. The solution is also expensive to realize, and it does not provide lubrication on the inner surface of the barrel, which would be necessary for the protection of the barrel.

U.S. Pat. No. 3,209,690 discloses a solution which in principle corresponds to the one disclosed in U.S. Pat. No. 2,765,740. In this solution, the part which is the first to travel through the barrel is connected by thin cords or wires to a piston which is disposed behind cleaning wadding and comprises a conical flange. When detonated, the powder at the forward end of the cartridge propels the foremost part out of the barrel and subsequently pulls the cone, which is the rearmost part and connected to the foremost part with cords, and also the cleaning wadding in front of this through the barrel, whereby the barrel is cleaned. This solution is also rather complicated and expensive to manufacture, and its reliability is questionable.

U.S. Pat. No. 3,740,883 discloses a solution in which a shell is provided with wadding and an intermediate wad disposed behind it. The intermediate wad and the wadding are propelled through the barrel when the primer of the cartridge is detonated, thereby cleaning the barrel. This solution is simple and effective, but the problem with this solution is that the combustion gases of the primer, which are very corrosive, remain in the barrel after the cleaning wad has travelled therethrough, whereby new corrosive material is deposited on the surface of the barrel. Nor does this solution provide sufficient lubrication of the inner surface of the barrel. Furthermore, the opening at the forward end of the cleaning cartridge may be filled with debris or other foreign material, which is injurious to the barrel.

U.S. Pat. Nos. 4,843,750 and 4,998,368 disclose a barrel cleaning cartridge which is based on a compressed gas cylinder and a separate cleaning wad of tow or the like. In the solutions according to these references, a puncturing pin is actuated by a firing pin, whereby the compressed gas escapes through the pin opening and propels the cleaning wad through the barrel. This solution is expensive and complicated, and it does not provide sufficient lubrication of the barrel under any conditions.

U.S. Pat. No. 5,072,672 discloses a solution in which a sheet or bushing containing a lubricant is provided in a shell. When powder burns, the sheet or bushing is expelled from the shell, lubricating thus the inner surface of the barrel. This solution is unreliable and has the drawback that after the lubricating surface has travelled through the barrel, burning powder gas and powder residue are deposited on the wall of the barrel.

German Patent No. 207,082 discloses a solution in which a shell is provided with a small powder charge, an intermediate wad and oil in a separate container. When the cartridge is detonated, the pressure caused by the powder gas in the barrel of the firearm propels the oil container, and the oil contained in it is spread on the inner surface of the barrel. This solution has the drawback that the corrosive combustion gases of both the powder and the primer are allowed to enter the barrel after the oil has been spread, which causes corrosion despite the oil.

German Offenlegungsschrift No. 3,617,814 discloses a solution in which an oil container is formed in a bullet, and a brush is attached to the outer surface of the bullet. The bullet is detonated either by compressed gas or by a conventional propelling charge through the barrel. The piston in the bullet causes the oil in the container to be sprayed through the spraying orifices of the bullet, and the brush brushes the surface of the barrel while the bullet travels therethrough. This solution is complicated and difficult to implement, and in addition to a bullet, it requires a separate propelling cartridge or a cartridge containing compressed gas. If a normal combustible propelling charge is used, corrosive material is deposited on the surface of the barrel after cleaning and oiling, which thus increases the risk of corrosion.

The object of the present invention is to provide a cartridge for spraying a liquid, by means of which debris, water, snow, etc., can be easily removed from the barrel of a firearm, or by means of which the inner surface of the barrel can be oiled and at the same time sufficiently cleaned simply and efficiently by the use of conventional components, and by means of which corrosion after the detonation of the cartridge is avoided. In the cartridge according to the invention the liquid space is formed by a liquid cylinder (3*a* ) positioned within the shell (1) and provided with an orifice (3*b* ) at the forward end thereof and containing said liquid (5) to be sprayed, said orifice (3*b* ) being sealed by a sealing means which is expelled by the action of pressure, said cylinder comprising a piston mounted at the end of the cartridge adjacent to the cap of the cartridge, said piston closing the other end of the liquid space (3*a* ), whereby the gas pressure formed when the propelling charge is detonated drives the piston (4) to the forward end of the cartridge and simultaneously propels the liquid in front of it, said sealing means being expelled by the action of the pressure thus formed, whereby the liquid (5) sprays along the barrel, and the combustion gases of the propelling charge remain within the cartridge behind the piston (4).

The essential feature of the invention is that the primer that is preferably used for spraying a liquid, such as a protective oil, is a primer which is conventionally used in a normal cartridge. The gases which are formed when the primer is detonated drive a separate piston forward, which in turn propels the liquid, preferably a protective oil, causing it to be pressurized. Consequently, the oil is sprayed through one or more orifices at the end of the cylinder into the barrel. When the orifice is appropriately shaped, the oil is sprayed to the inner surface of the barrel, part of it being sprayed out of the muzzle. The spray of oil protects the inner surface of the barrel and carries away at least any larger particles and foreign materials. The corrosive compounds formed while the detonating mass is burning remain within the shell, behind the piston so as not to injure the protected surface of the barrel. Such a cartridge can be implemented simply and easily by using a normal shell and a normal primer, and by manufacturing the cylinder and piston easily, for instance, by injection moulding or some other suitable method. In addition, it is simple and inexpensive to manufacture such a cartridge, and it is even possible to manufacture it completely automatically. A further advantage of the cartridge is that the protective oil or some other liquid is caused to be sprayed through the barrel at high speed; thus any possible debris, snow, etc., is discharged from the barrel at low pressure so that the barrel is not damaged. If the oil is replaced with some other liquid or mixed, for example, with alcohol, the barrel can be cleaned from various foreign materials under any conditions, even when water has frozen on the inner surface of the barrel. The cartridge according to the invention is also inexpensive to manufacture and can be applied to all firearms operating by powder gas.

Figure 2A:
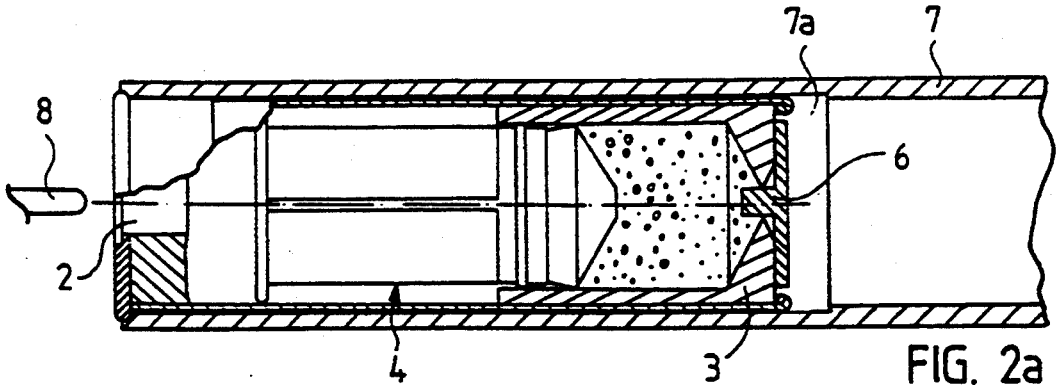
Figure 2B:
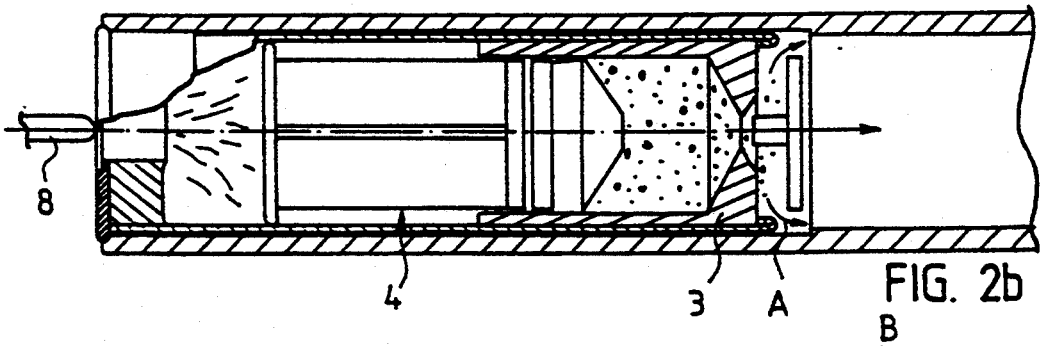
Figure 2C:
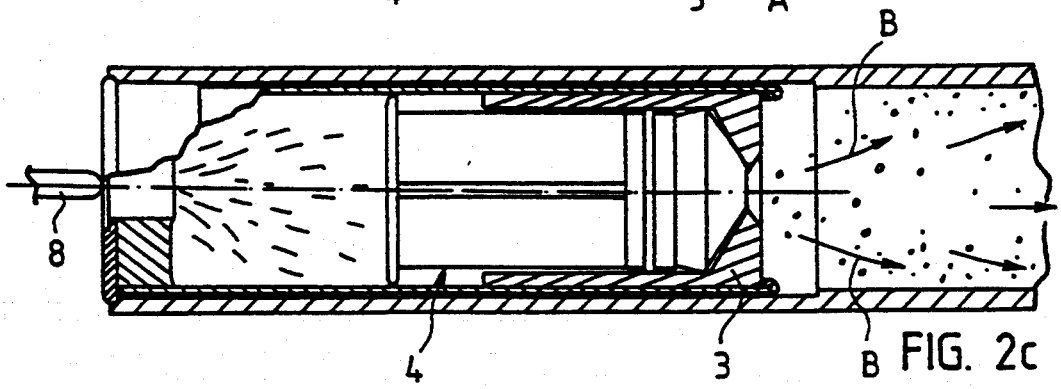
Figure 3:
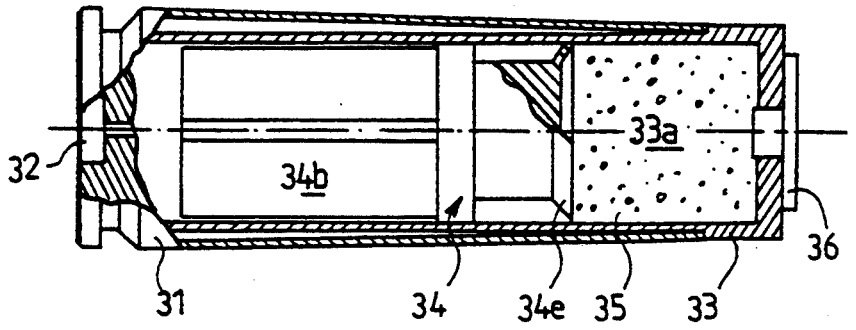
Figure 4:
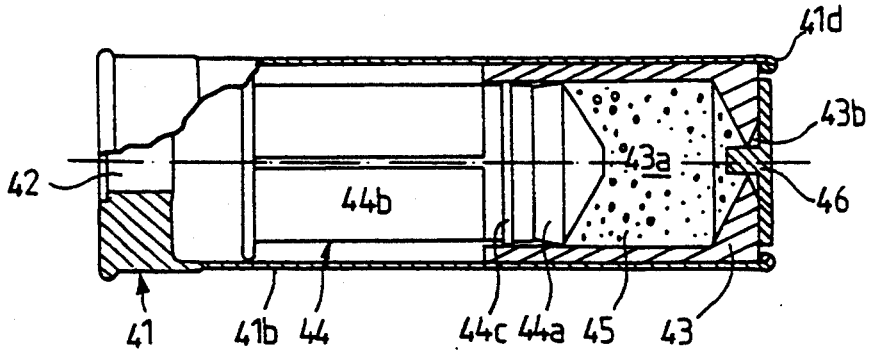
Figure 5:
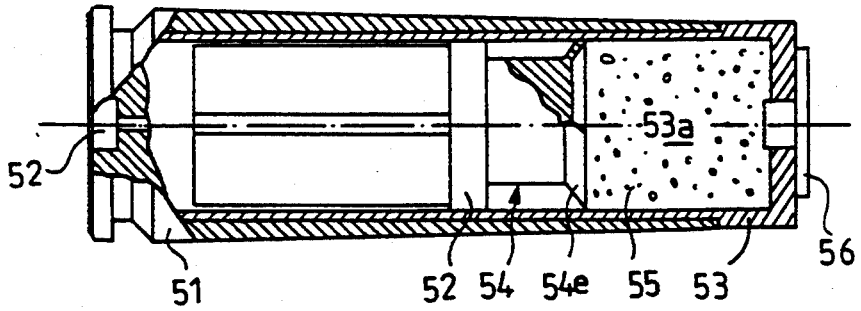
Figure 6:
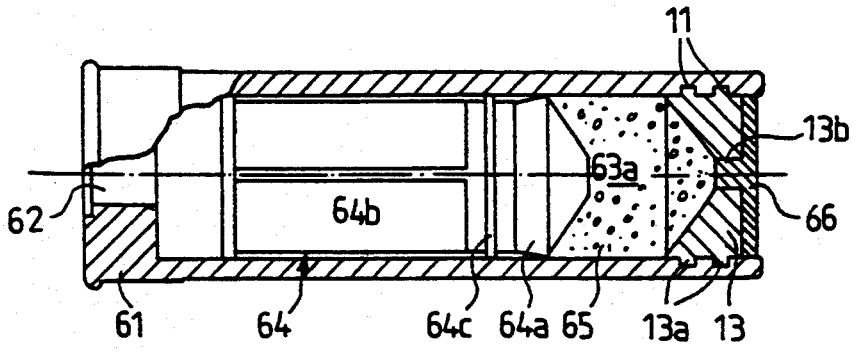

In the following, the invention will be described in greater detail with reference to the accompanying drawings, in which FIG. 1 is a schematic cross-sectional view of a cartridge according to the invention designed to be used in a shotgun, FIGS. 2*a* to 2*c* illustrate the operation of the cartridge shown in FIG. 1, FIG. 3 is a schematic cross-sectional view of a cartridge according to the invention designed to be used in a rifle, FIG. 4 is a schematic view of another embodiment of the cartridge designed to be used in a shotgun or the like, FIG. 5 is a schematic view of another embodiment of the cartridge designed to be used in a rifle, and FIG. 6 is a schematic view of an embodiment of the cartridge in which the shell as such forms a liquid cylinder.

FIG. 1 is a schematic cross-sectional view of a cartridge for use in a shotgun. The cartridge comprises a shell 1, which in the known manner consists of a cap 1*a* and a casing 1*b*. It further comprises a filler portion 1*c*, which is disposed within the cap and which together with the cap 1*a* forms a primer casing for a primer 2 used as a propelling charge. The primer 2 is a conventional shotgun primer, and the shell 1 of the cartridge is a conventional shell also used in normal charges. The forward end of the shell 1 comprises a cylinder portion 3 with a liquid cylinder 3*a* and an orifice 3*b* at the forward end thereof towards the forward end of the barrel. The cartridge further comprises a piston 4 slidingly mounted in the liquid cylinder 3*a*. The head 4*a* of the piston forms one end of the liquid cylinder 3*a*, the piston being in tight connection with the inner surface of the liquid cylinder. In addition, the piston 4 comprises a rod 4*b*, which supports the piston in the longitudinal direction when the piston moves, and a flange portion 4*d* at the end of the rod. The piston also comprises a separate gasket ring 4*c* between its head and rod, the gasket ring sealing the piston 4 with respect to the wall of the liquid cylinder 3*a* and supporting the piston 4. The liquid cylinder 3*a* contains a liquid 5, and in order to prevent the liquid from escaping, the cylinder 3*a* is provided with a plug 6 disposed as a sealing means at the orifice 3*b*. The plug 6 remains normally in place but is ejected from the orifice by the pressure formed in the liquid cylinder 3*a*. The cylinder portion 3 is secured to the shell 1 by a suitable method, for instance by glueing or, if the shell is made of plastic, by ultrasonic welding, for example. The cylinder portion 3 can also be attached to the shell by forming a shoulder 1*d* on the edge of the shell to keep the cylinder portion inside. Even in this case the mounting can be ensured, for example, with glue or the like, if necessary for reasons of strength.

When the cartridge is used, it is inserted in the barrel of a firearm as shown in FIG. 2*a*, whereby it is ready for operation in the position according to FIG. 1. When the firearm is fired, the firing pin strikes the primer 2 as shown in FIG. 2*b*. The detonating mass of the primer burns, forming combustion gases which rapidly drive the piston 4 forward, pressurizing thus the liquid in the liquid cylinder 3*a*. When the pressure becomes sufficiently high, the pin-like protrusion of the plug 6 is expelled from the orifice, whereby the plug 6 flies towards the free end of the barrel. At the same time, the liquid in the liquid cylinder 3*a* is discharged through the orifice 3*b* and is spread widely around the cartridge as indicated by arrow A, covering the inner surface of the barrel starting from the immediate vicinity of the cartridge. When the plug 6 has flown farther, the spray of liquid, as shown in FIG. 2*c*, travels more linearly towards the muzzle of the barrel as indicated by arrows B, covering the whole length of the barrel while the piston 4 is driven forward, emptying the entire liquid cylinder 3*a*. The combustion gases formed upon detonation of the primer 2 remain within the cartridge, sealed by the piston 4 and the cylinder portion 3, and are thus not allowed to escape to the inner surface of the barrel. The liquid is sprayed out in practice at such a high flow rate that it carries debris and other possible foreign material, such as snow, through the barrel and out of it.

FIG. 3 is a schematic view of the cartridge according to the invention when applied to a more conical shell, such as a rifle shell or the like. Elements similar to those of FIG. 1 are identified by similar reference numerals with the prefix "3" added. This embodiment correspondingly employs a conventional brass shell blank 31, within which there is disposed a cylinder portion 33 which is longer than the one in FIG. 1. The cylinder portion 33 may also be shorter as long as the liquid cylinder 33a has sufficient volume. The cylinder portion 33 is secured to the brass shell blank for instance by glueing or some other suitable method so as to remain stationary despite the pressure exerted by the gas of the primer. In this case, the shape of the shell 31 is not identical with that of a normal shell but it is shorter; the liquid cylinder must however have sufficient volume even in firearms where shells that are normally used are convergent at the forward end. The piston is similar to the one in the embodiment shown in FIG. 1, but the head of the piston is more level. In addition, the edge of the piston is provided with a collar-like gasket portion 34e, which seals the piston tightly with respect to the walls of the liquid cylinder 33a. In this case, a cylindrical orifice is used, as in this embodiment the spray of liquid starts to cover the barrel already in the cartridge chamber and does therefore not have to be spread as widely as in a shotgun. The cartridge illustrated in FIG. 3 operates in the same way as the one shown in FIG. 1, wherefore the operation is not described in more detail in this connection.

FIGS. 4 and 5 illustrate embodiments which correspond to the solutions according to FIGS. 1 and 3 but where the whole cartridge is made, for example, of a plastic material by injection moulding or some other suitable method. Elements similar to those of FIG. 1 are identified with similar reference numerals with the added prefix "4" or "5", respectively in FIGS. 4 and 5. The shell 1 shown in both of the figures is made of plastic by injection moulding, wherefore it is of a uniform material. Thus the wall thickness and shape of the shell can be selected as desired. The propelling charge that is used is a conventional primer even in these embodiments, as it is quite inexpensive to manufacture and use. As the formed gas pressure is low, it does not put stress on the lock, cartridge chamber or barrel of the firearm although the shell is made of plastic. With this method, the manufacturing costs can be kept relatively low.

In the embodiment illustrated in FIG. 6, wherein elements similar to those in FIG. 1 are provided with the prefix "6", both a shell 61 and a liquid cylinder 63a are formed as a uniform shell portion, within which a piston 64 is provided. In this case, the liquid cylinder 63a is sealed by means of a sealing plug 13 disposed at the end of the shell. In the example, the sealing plug 13 is mounted in place by inserting fillets 13a formed around the sealing plug 13 into grooves 11 formed in the shell, for instance by heating the end of the shell 1, which is left larger at the manufacturing step, and compressing it after the sealing plug 13 has been inserted in place. The sealing plug 13 can also be mounted without fillets and grooves, for example by ultrasonic welding, glueing or some other method so as to form a uniform, tight body with the shell 1. The sealing plug 13 is provided with an orifice 13b, which, as in the case of FIG. 1, is slightly divergent so as to allow the liquid to spray out as widely as possible once the plug 66 has been expelled from the orifice 13b. The head of the piston 64 and the inner surface of the sealing plug 13 are of a substantially identical conical shape in order that all possible liquid might be discharged through the orifice.

In the specification and drawings the invention is described merely by way of example, and it is by no means limited to these embodiments. In the preferred embodiment of the invention the cartridge serves as a protective agent cartridge; the liquid cylinder contains thus a protective agent suitable for protecting the inner surface of the barrel, such as oil or the like. When the cartridge is detonated, the protective agent contained in it spreads to cover the entire inner surface of the barrel so as to prevent corrosion caused, for example, by moisture. At the same time the protective agent contained in the cartridge removes debris and moisture from the inner surface of the barrel. In addition to protecting the barrel, the protective agent can also be used for light cleaning of the barrel even if protection as such is not needed. Instead of mere protective oil or other protective agent it is possible to use a mixture of oil and some other agent, such as alcohol, whereby moisture can be efficiently removed from the surface of the barrel. It is also possible to use different oils for different purposes according to the conditions in which the firearm is used: for example, a mixture of oil and some other agent in winter conditions, and oil in summer conditions. The conventional primer can, of course, be replaced with separate propelling charges, which however makes it more difficult to apply the solution, as a conventional primer is simple and inexpensive to manufacture. As shown in the drawings, the piston may have a rod and it may have different shapes. The piston may also be provided with various gasket rings or be made of a material which itself acts as a gasket. In addition to having a rod as shown in the drawings, the piston may also be substantially uniform and made of a solid material: different plastics, metal, etc. The cartridge may also be made of various materials, and if desired, it can also be reusable: for reuse it is filled with new oil and provided with a new plug and a new primer.

The liquid cylinder has preferably a round cross-section, but it may also be angular, oval, etc., as long as it contains a piston which tightly slides along the inner surface of the liquid cylinder. In principle, the shell and the liquid cylinder inside it can also be made of metal, if this is considered necessary. Instead of a sealing plug 6, it is possible to use various pins for sealing the liquid spray orifice(s), or paper, a plastic film or the like mounted on top of the orifice(s), as long as the liquid is allowed to spray out through the orifice(s) as desired when the primer is detonated. In addition to small-calibre portable firearms, the cartridge according to the invention can also be used correspondingly in large-calibre and heavy firearms. The cartridge does not have to extend over the entire length of the cartridge chamber, but the minimum length of the cartridge is determined by its operation. The cross-section of the cartridge may also be other than circular as long as the cartridge is supported by the cartridge chamber in such a manner that it can be reliably fired.

I claim:

1. A cartridge for spraying a liquid comprising at least an agent protective against corrosion into the barrel of a firearm, said cartridge comprising a shell, a propelling charge detonated by the action of a firing pin of the firearm, and a liquid space within said shell containing said liquid to be sprayed, said liquid space defining a liquid cylinder at a forward portion of the shell and provided with at least one orifice at a forward end thereof, said at least one orifice being sealed by a sealing means which is expelled from the cartridge by the action of pressure, a piston being mounted in said cylinder at an end of the cartridge adjacent to a cap of the cartridge, said piston being in a tight connection with an inner surface of the liquid cylinder, said piston closing an opposite end of the liquid space and defining a space rearward of the piston into which combustion gases of the propelling charge are discharged upon detonation of the propelling charge, whereby the gas pressure formed when the propelling charge is detonated drives the piston to the forward end of the cartridge and simultaneously propels the liquid in front thereof, said sealing means being expelled by the action of the pressure thus formed, whereby the liquid sprays along the barrel, and the combustion gases of the propelling charge remain within the cartridge behind the piston.

2. A cartridge according to claim 1, wherein the propelling charge is a conventional primer.

3. A cartridge according to claim 1, wherein the shell of the cartridge comprises a plastic material.

4. A cartridge according to claim 1, wherein the liquid cylinder is formed of a separate cylinder portion which is disposed within the shell and secured thereto.

5. A cartridge according to claim 1, wherein the sealing means is a separate plug comprising a flange and a pin-like protrusion which fits in the at least one orifice and presses tightly against an inner surface of the at least one orifice.

6. A cartridge according to claim 1, wherein said liquid cylinder is formed by an inner cylindrical wall surface of said shell, and a sealing plug is provided at the forward end of said shell.

7. A cartridge according to claim 6, wherein the shell of the cartridge comprises a plastic material.

8. A cartridge according to claim 6, wherein said sealing means comprises a flange and a pin-like protrusion which fits in the at least one orifice and presses tightly against an inner surface of the at least one orifice.

9. A cartridge according to claim 6, wherein said at least one orifice for receiving said sealing means is formed in said sealing plug.

* * * * *